US009453425B2

(12) United States Patent
Brummitt-Brown et al.

(10) Patent No.: US 9,453,425 B2
(45) Date of Patent: Sep. 27, 2016

(54) TURBINE DIAPHRAGM CONSTRUCTION

(71) Applicant: ALSTOM Technology Ltd, Baden (CH)

(72) Inventors: Angus Robert Brummitt-Brown, Warwickshire (GB); Adrian Clifford Lord, Warwickshire (GB); Niall MacDonald, Leicestershire (GB)

(73) Assignee: General Electric Technology GmbH, Baden (CH)

( * ) Notice: Subject to any disclaimer, the term of this patent is extended or adjusted under 35 U.S.C. 154(b) by 582 days.

(21) Appl. No.: 13/897,572

(22) Filed: May 20, 2013

(65) Prior Publication Data

US 2013/0309075 A1 Nov. 21, 2013

(30) Foreign Application Priority Data

May 21, 2012 (EP) ..... 12168682

(51) Int. Cl.
*F01D 5/22* (2006.01)
*F01D 9/04* (2006.01)

(52) U.S. Cl.
CPC ..... *F01D 9/045* (2013.01); *F01D 5/225* (2013.01); *F01D 9/041* (2013.01); *F05D 2220/31* (2013.01); *F05D 2260/36* (2013.01); *Y10T 29/49316* (2015.01)

(58) Field of Classification Search
CPC ..... F01D 9/045; F01D 9/041; F01D 5/225; F01D 25/246; F05D 2260/36; Y10T 29/49316; Y10T 29/49323
USPC ..... 416/212 A
See application file for complete search history.

(56) References Cited

U.S. PATENT DOCUMENTS

| | | | | |
|---|---|---|---|---|
| 2,220,918 | A | 11/1940 | Smith | |
| 4,714,410 | A * | 12/1987 | Hancock | F01D 5/141 416/193 A |
| 4,921,405 | A | 5/1990 | Wilson | |
| 5,451,142 | A | 9/1995 | Cetel et al. | |
| 6,217,282 | B1 | 4/2001 | Stanka | |
| 6,425,738 | B1 | 7/2002 | Shaw | |
| 6,910,854 | B2 * | 6/2005 | Joslin | F01D 5/225 415/139 |
| 2002/0071764 | A1 * | 6/2002 | Turnquist | F01D 5/225 415/173.3 |
| 2004/0170496 | A1 | 9/2004 | Powis et al. | |
| 2006/0245715 | A1 * | 11/2006 | Matsumoto | F01D 5/147 385/147 |

(Continued)

FOREIGN PATENT DOCUMENTS

| | | |
|---|---|---|
| DE | 485833 C | 11/1929 |
| JP | 2008-144687 | 6/2008 |
| SE | 128499 C1 | 6/1950 |

(Continued)

*Primary Examiner* — Ninh H Nguyen
*Assistant Examiner* — Aaron R Eastman

(57) ABSTRACT

An axial flow turbine diaphragm is constructed without welding or other metal joining techniques as an annular array of static blade units. Each blade unit comprises an aerofoil and radially inner and outer platforms integral with the aerofoil. The radially inner platform consists of a segment of the inner diaphragm ring and the radially outer platform consists of a segment of the outer diaphragm ring. At least the outer ring segment has engagement features that mechanically engage with complementary engagement features on neighboring outer ring segments in the annular array of blade units, the engagement features acting to mechanically interlock neighboring outer ring segments and produce a self-supporting turbine diaphragm.

14 Claims, 3 Drawing Sheets

(56) References Cited

U.S. PATENT DOCUMENTS

| | | | | |
|---|---|---|---|---|
| 2008/0170939 | A1* | 7/2008 | Palmer | F01D 9/041 415/209.2 |
| 2012/0034086 | A1* | 2/2012 | Mishrikotkar | F01D 5/3007 416/219 R |

FOREIGN PATENT DOCUMENTS

| | | | |
|---|---|---|---|
| WO | 2006/100256 | | 9/2006 |
| WO | 200610025 | A1 | 9/2006 |
| WO | 2012041651 | A1 | 4/2012 |

* cited by examiner

TURBINE DIAPHRAGM CONSTRUCTION

TECHNICAL FIELD

This disclosure relates to the construction of diaphragms for turbines, and in particular, to a novel structure and assembly process for diaphragms in axial flow steam turbines.

TECHNICAL BACKGROUND

A known way of constructing a steam turbine diaphragm is to mount an annulus of static guide blades between an inner ring and an outer ring. Each such blade comprises a blade unit in which an aerofoil portion extends between an inner platform and an outer platform, the blade unit being machined as a single component. This is known as the "platform" type of construction. Each platform is in the form of a segment of a cylinder so that when the annulus of blade units is assembled the inner platforms combine to create an inner port wall and the outer platforms combine to create an outer port wall. The inner platforms are welded to an inner ring that retains the turbine blades and provides a mount for a sealing arrangement, such as a labyrinth seal, that acts between the inner ring and a rotor shaft of the turbine. The outer platforms are welded to an outer ring that provides support and rigidity to the diaphragm. Each of the inner and outer rings usually comprises two semi-circular halves which are joined along a plane that contains the major axis of the diaphragm and passes between blade units so that the entire diaphragm can be separated into two parts for assembly around the rotor of the turbo-machine.

Existing platform constructions for HP or IP steam turbine diaphragms generally comprise solid inner and outer rings cut from thick metal plate, or forged, or formed from bar stock. Since such rings in large turbines have substantial dimensions in the axial and radial directions of the turbine, e.g., 100 mm to 200 mm, the cost of welding together the components of the diaphragm is a significant factor in the price of a large steam turbine, not least because the necessary deep penetration welds require advanced specialist welding equipment for their production. Furthermore, welds are a possible source of metallurgical defects in the diaphragm and it is also necessary to heat treat the diaphragm in order to relieve stresses caused by the welding processes.

SUMMARY OF THE DISCLOSURE

In its broadest aspect, the present disclosure provides an axial flow turbine diaphragm comprising an annular array of blade units, each blade unit comprising:

an aerofoil;

radially inner and outer platforms integral with the aerofoil, the radially inner platform comprising a segment of the inner diaphragm ring and the radially outer platform comprising a segment of the outer diaphragm ring, at least the outer ring segment comprising engagement features that mechanically engage with complementary engagement features on neighbouring outer ring segments in the annular array of blade units, the engagement features acting to interlock neighbouring outer ring segments and produce a self-supporting turbine diaphragm.

The above concept enables the blade units to be assembled and held together entirely by mechanical means, so that the diaphragm can be constructed to near net shape without welding or other metal inciting or adhesive techniques.

Note also that, upon assembly of the blade units to form the diaphragm, the radially outer port wall of the diaphragm consists of the radially outer ring segments that form the outer platforms of the blade units, and the radially inner port wall of the diaphragm consists of the radially inner ring segments that form the inner platforms of the blade units.

Clearly, with regard to their dimensions and surface finishes, the blade units, including their inner and outer ring segments should be accurately manufactured and closely matched to each other, so that the inner and outer port walls of the diaphragm are sufficiently smooth to avoid excessive aerodynamic drag penalties.

To maintain diaphragm integrity against loads acting axially across the diaphragm—in particular turbine fluid loadings on the aerofoils, which tend to produce bending stresses in the outer ring of the diaphragm—the engagement features on the outer ring segment of each blade unit include hook features on both circumferentially facing sides of the outer ring segment that engage with complementary features on neighbouring outer ring segments of adjacent blade units, the hook features being oriented to maintain axial location of each blade unit relative to its neighbours.

To maintain diaphragm integrity against loads acting radially across the diaphragm. the engagement features on the outer ring segment of each blade unit include tongue and groove features that engage with complementary features on the outer ring segments of adjacent blade units, the tongue and groove features being oriented to maintain radial location of each blade unit relative to its neighbours.

Preferably, the tongue and groove features comprise:

(i) a groove on a circumferentially facing first side of the outer ring segment, the groove being formed as a gap between a radially outer part of a hook and a radially outer, circumferentially projecting lip portion of the outer ring segment; and (ii) a circumferentially projecting tongue projecting from a circumferentially facing second side of the outer ring segment in exact opposition to the groove on the first circumferentially facing side.

If required in order to resist bending stresses experienced during turbine fluid loading across the diaphragm, the inner ring segment of each blade unit may also comprise engagement features that mechanically engage with complementary features on neighbouring inner ring segments in the annular array of blade units and that are operative to produce a self-supporting turbine diaphragm in cooperation with the engagement features on the outer ring segments. Such engagement features on the inner ring segment of each blade unit may include hook features that engage with complementary hook features on neighbouring inner ring segments of adjacent blade units, the hook features being oriented to maintain axial location of each blade unit relative to its neighbours. Such engagement features on the inner ring segments may be omitted if the engagement features on the outer ring segments are sufficient in themselves to adequately resist turbine fluid loadings across the diaphragm.

The hook features on the radially inner ring segment of each blade may comprise a first hook, constituted by a radially extending groove proximate the pressure side of the aerofoil, and a second hook, constituted by a radially extending groove proximate the suction side of the aerofoil.

Also disclosed is an embodiment of a blade unit suitable for constructing a diaphragm in accordance with the above concept.

Furthermore, a method of assembling the turbine diaphragm comprises the steps of:

(a) producing the individual blade units to their final shape;

(b) placing a first blade unit on a flat surface ready for coupling with further blade units;

(c) sliding a second blade unit axially into engagement with the first blade unit and the flat surface so that engagement features on the outer ring segment of the second blade unit mate with the complementary engagement features on the outer ring segment of the first blade unit; and (d) successively sliding further blade units axially into engagement with blade units that are already engaged with each other and the flat surface until the annulus of the diaphragm is complete.

If engagement features are also present on the inner ring segments of the blade units, such engagement features will mate with each other in parallel with the engagement features on the outer ring segments.

Further aspects of the present disclosure will become apparent from a study of the following description and the appended claims.

BRIEF DESCRIPTION OF THE DRAWINGS

Embodiments of the concept disclosed herein will now be described, with reference to the accompanying drawings, which are not to scale, wherein.

DETAILED DESCRIPTION OF PREFERRED EMBODIMENTS

Figure 1A:
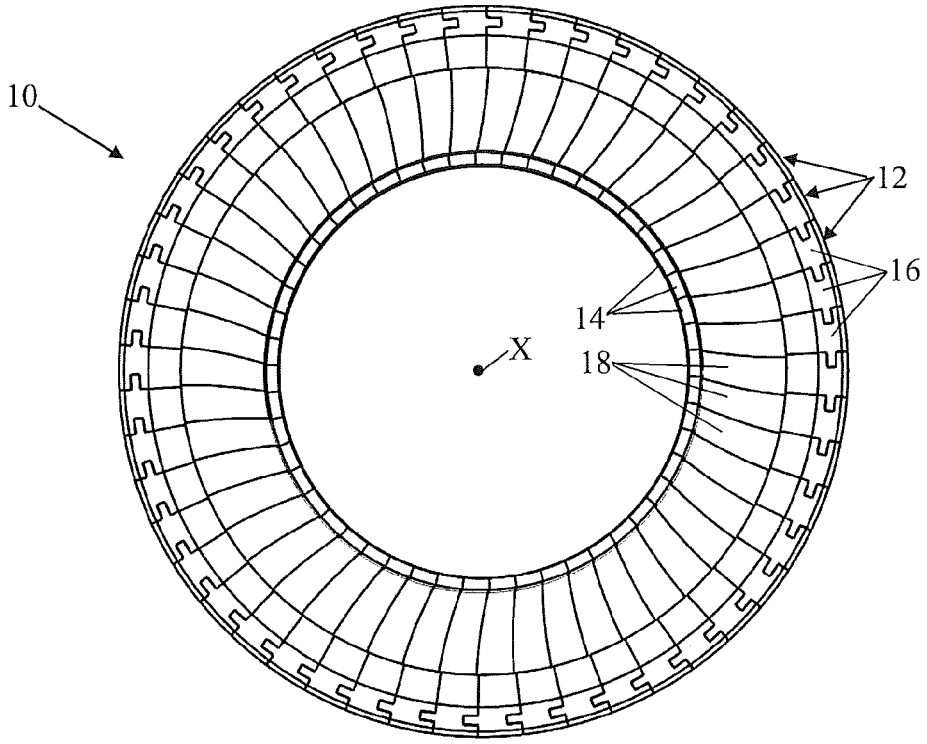
FIG. 1A is a view on the steam inlet side of an embodiment of the present concept, showing an HP or IP steam turbine diaphragm after assembly from individual blade units.
Figure 1B:
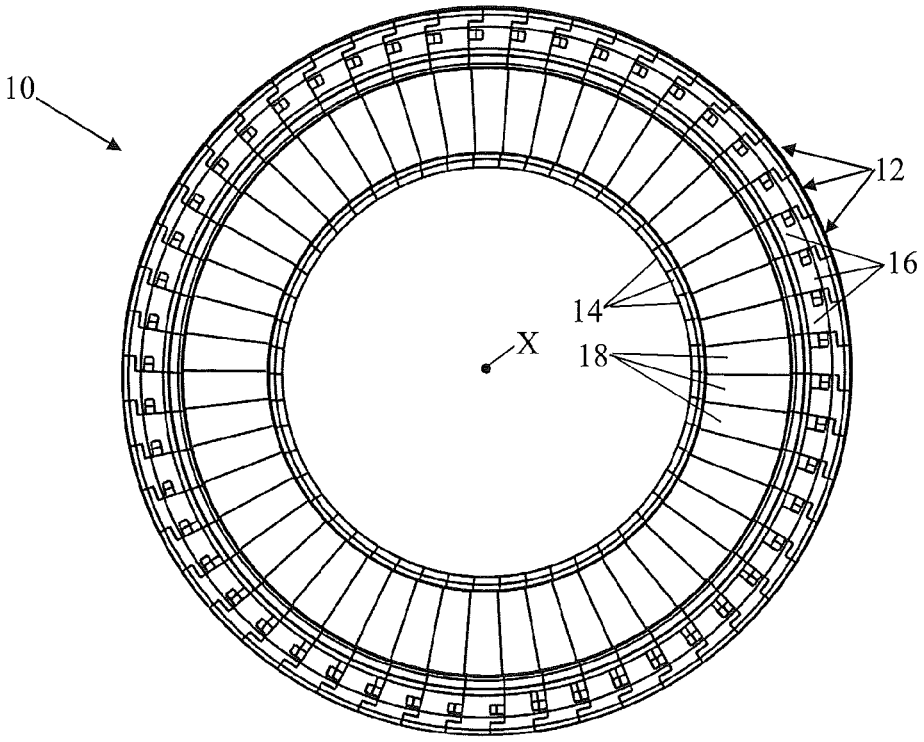
FIG. 1B is a view on the steam outlet side of the diaphragm of FIG. 1A.

FIGS. 1A and 1B respectively show the leading or inlet side and the trailing or outlet side of a high or medium pressure steam turbine diaphragm 10 having a major axis X-X. Steam turbine diaphragms are normally constructed by welding their components together, but in accordance with the present disclosure, diaphragm 10 may be constructed without welding or other fusion or adhesive metal joining techniques.

In brief, the present concept is to integrate portions of all the usual features of a diaphragm 10 into each blade unit 12, i.e. aerofoils 18, outer ring 16 and inner ring 14, so that when all the blade units are mechanically joined and fitted together, the result is a complete diaphragm made without welding, etc., needing only final machining of circular features and/or fitting of seals, etc., to produce the finished article. Thus, each blade unit 12 forms a complete segment of the annulus of the diaphragm 10. In the embodiment shown there are 50 segments, but the number of segments may be varied, depending, e.g., upon the diameter of the diaphragm and the chord dimension of the aerofoils.

When installed in the turbine, the outer ring (and hence the entire diaphragm) may be supported within a surrounding turbine casing (not shown) by means of cross-key location features (not shown), as well known in the industry.

In more detail, each blade unit 12 comprises a radially inner platform acting as a segment 14 of an inner diaphragm ring, a radially outer platform acting as a segment 16 of an outer diaphragm ring, and an aerofoil 18 extending between the inner and outer diaphragm ring segments 14, 16. The illustrated embodiment is a diaphragm with a radially compact type of construction, which has a much reduced radial thickness of its inner diaphragm ring compared with the more robust type of construction traditionally used for large steam turbines. However, the concept discussed herein is also applicable to diaphragms having inner rings which are radially thicker than the one illustrated.

To enable production of the diaphragm shown in FIGS. 1A and 1B, the blade units are manufactured and assembled as shown in the perspective views of FIGS. 2A to 3C.

Figures 2A, 2B:
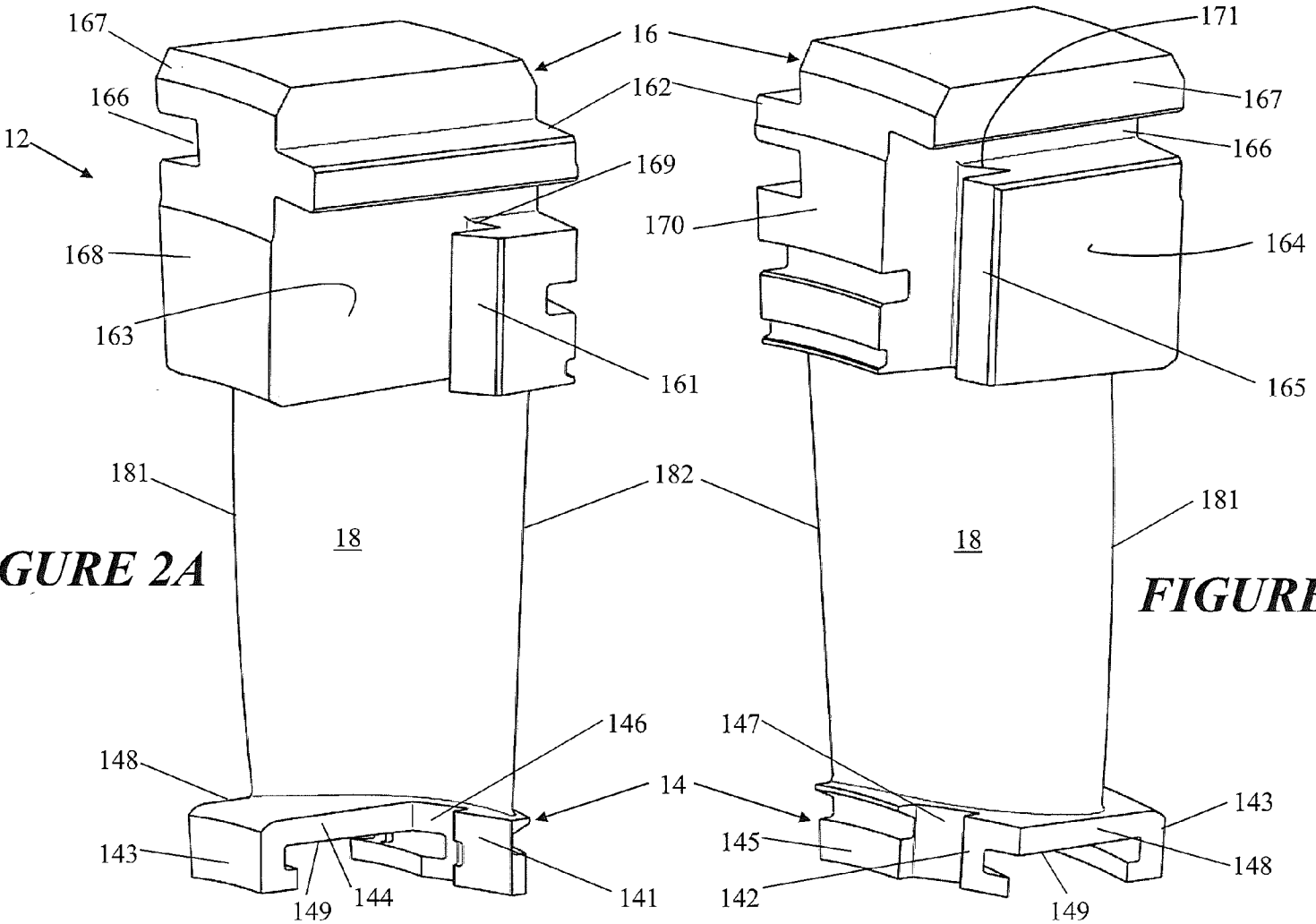
FIG. 2A is a three-dimensional perspective view on the pressure side of a blade unit ready for incorporation into the steam turbine diaphragm of FIG. 1.
FIG. 2B is a view of the suction side of the blade unit of FIG. 2A.

Referring now to FIGS. 2A and 2B, a representative blade unit 12 is shown ready for coupling with adjacent identical blade units in order to form a diaphragm; FIG. 2A is a view looking at the pressure (concave) side of the aerofoil 18, and FIG. 2B is a view looking at the suction (convex) side of the aerofoil. To enable locking together of the components of the diaphragm without the use of welding or other fusion or adhesive metal-joining techniques, at least the outer ring segment 16 has engagement features in the form of a hook 161 and a tongue 162 on one circumferentially facing side 163 of the segment, whereas the opposing circumferentially facing side 164 of the segment, has engagement features in the form of a hook 165 and a groove 166, the hook 165 and the groove 166 being complementary in shape to the hook 161 and the tongue 162, respectively.

To produce hook 161, a large part of the inlet side 168 of the outer ring segment 16 is cut away through its radial and circumferential thickness to make an axially deep rebate (rabbet in US English) that extends in the axial direction to a position proximate the pressure side of the aerofoil 18, ending in a radially extending groove 169 that forms the hook 161. To produce the hook 165, a rebate in the outlet side 170 of the outer ring segment 16 matches the circumferential extent of the rebate in the inlet side 168, but is more radially extensive and axially shallower, ending in a radially extending groove 171 that forms the hook 165.

In the illustrated embodiment, the groove 166 on the side 164 of the outer ring segment 16 is conveniently formed as a gap between the radially outer part of the hook 165 and a radially outer, circumferentially projecting lip portion 167 of the outer ring segment. The circumferentially projecting tongue 162 must of course project from the side 163 of the outer ring segment 16 in exact opposition to the groove 166 on side 164.

Upon assembly into the diaphragm, side 163 of the outer ring segment abuts side 164 of a circumferentially adjacent outer ring segment, so that hook 161 on side 163 engages with hook 165 on side 164, thereby providing axial location of the blade unit 12 within the diaphragm, and tongue 162 on side 163 engages with groove 166 on side 164, thereby providing radial location. When the fully constructed diaphragm is part of a functioning turbine, the edge 181 of each aerofoil 18 will be its leading edge and the edge 182 will be its trailing edge and the aerofoil 18 will experience steam loading. There will be a pressure drop across the diaphragm in the axial direction from the leading edge 181 to the trailing edge 182 of the aerofoil 18, i.e., from the inlet face of the diaphragm to its outlet face, and a resultant bending moment. The interlock of the hook 161 with the hook 165 resists this axial force and bending moment. In fact, the combination of hooks for axial location and tongue and groove for radial location effectively provides cross-key location of the outer ring segments 16 relative to each other, thus stabilising the blade units 12 within the diaphragm structure.

In the illustrated embodiment, it has been assumed that the hooks 161/165 alone will not be sufficient to carry all the axially acting steam load forces during operation of the turbine, and therefore the inner ring segment 14 is also provided with mutually complementary engagement features in the form of a further pair of axially interlocking hooks 141 and 142.

To produce hook 141, a large part of the inlet side 143 of the inner ring segment 14 is cut away through its radial thickness to make a deep rebate (rabbet in US English) 144 that extends in the axial direction to a position proximate the pressure side of the aerofoil 18, ending in a shallow radially extending groove 146 that forms the hook 141. However, in order to produce the hook 142, it is only necessary to cut a shallow radially extending groove 147 in the outlet side 145 of the inner ring segment 14, proximate the suction side of the aerofoil 18, Upon assembly of the blade units into the diaphragm, axial rebate 144 of the inner ring segment 14 confronts circumferentially facing side 148 of a circumferentially adjacent inner ring segment, so that hook 141 engages with hook 142, thereby providing further axial location of the blade unit 12 within the diaphragm.

It should be understood that the shapes of the tongue 162, groove 166 and hooks 141, 142, 161, 165, could be varied from those shown in the drawings, which are exemplary. For instance, the tongue 162 and the slot 166 could be T-shaped, dove-tail shaped or some other undercut or re-entrant shape.

Figure 3A:
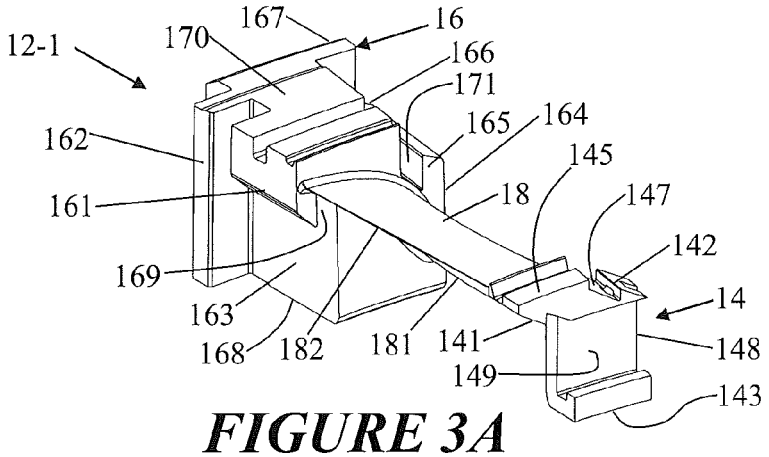
FIGS. 3A to 3C are views showing stages in the assembly of the diaphragm
Figure 3B:
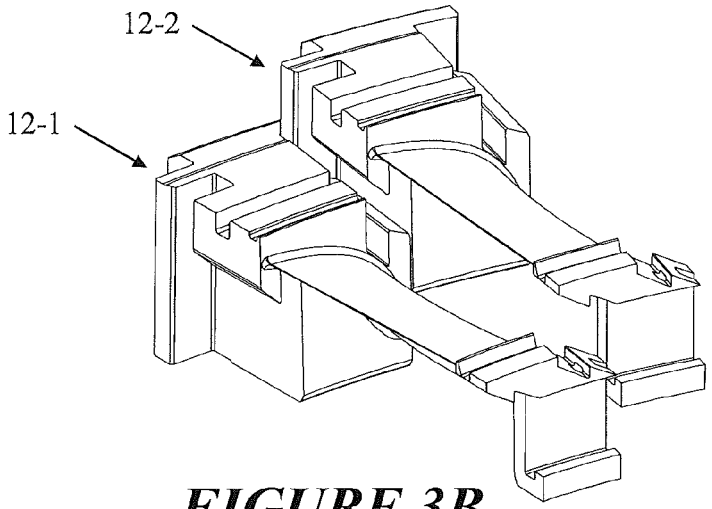
Figure 3C:
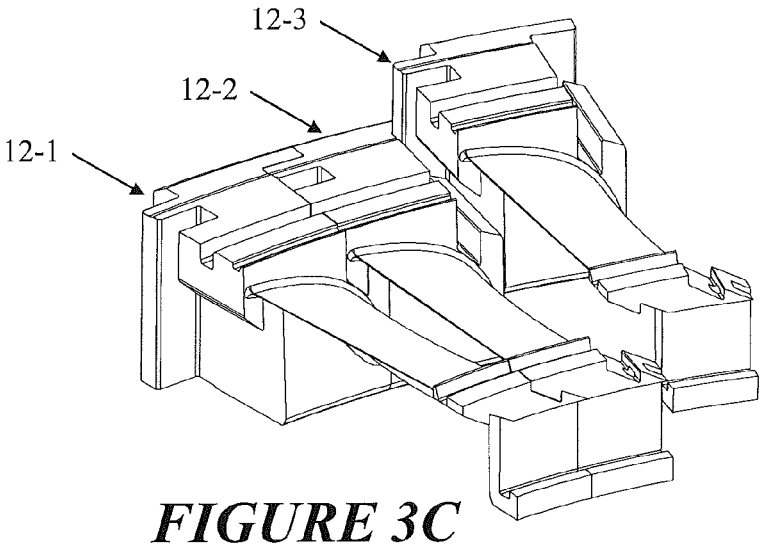

Assembly of the diaphragm 10 will now be described with reference to FIGS. 3A to 3C. FIG. 3A has been labelled with reference numbers and lead lines to enable comparison with FIGS. 2A and 2B, but FIGS. 3B and 3C have not been so labelled to avoid obscuring detail.

Firstly, the individual blade units for incorporation in the diaphragm are produced to final shape before assembly. FIG. 3A shows a first blade unit 12-1 placed on a flat surface ready for coupling with further blade units to make the diaphragm. FIG. 3B shows a second blade unit 12-2 being slid axially into engagement with the first blade unit and the flat surface so that engagement features on the outer and inner ring segments of the second blade unit 12-2 mate with the complementary engagement features on the outer and inner ring segments of the first blade unit 12-1. Specifically, tongue 162 on side 163 of the outer ring segment 16 of the second blade unit engages slot 166 on side 164 of the outer ring segment of the first blade unit, hook 161 on side 163 of the outer ring segment of the second blade unit engages hook 165 on side 164 of the outer ring segment of the first blade unit, and hook 141 on the inner ring segment of the second blade unit engages hook 142 on the inner ring segment of the first blade unit. FIG. 3C shows the first and second blade units in their final engaged and interlocked position on the flat surface and a third blade unit 12-3 being slid axially into engagement with the first blade unit.

In the radially compact embodiment shown in the Figures, the radially inner side of each segment 14 of the radially inner ring 12 comprises a circumferentially extending recess 149 configured to retain a separate seal (not shown) for sealing directly against a rotor when the diaphragm has been assembled into a turbine, the seal being necessary to restrict leakage between relatively high and low pressure sides of the diaphragm. Such a seal may comprise a labyrinth seal, a brush seal or a leaf seal, for example. Alternatively, the radially inner side of each segment 14 of the radially inner ring 12 may be configured as a labyrinth seal, so that sealing fins (not shown) project directly from the radially inner side of each segment towards a confronting rotor.

In the traditional type of platform construction for steam turbine diaphragms, the blade units are machined as single components complete with aerofoils and inner and outer platforms, so that when the platforms are welded onto their respective inner and outer rings, the inner and outer platforms combine to create circumferentially continuous inner and outer port walls. It will be appreciated from the drawings and the above description that the present concept comprising interlocking inner and outer ring segments also results in circumferentially continuous inner and outer port walls. However, it is important that the inner and outer port walls are sufficiently smooth to avoid excessive aerodynamic drag penalties, and to this end the engagement features of the inner and outer ring segments should be accurately manufactured and closely matched to each other with regard to their dimensions and surface finishes.

Adoption of the concept proposed herein confers the following advantages.

- Apart from the possible addition of seals or the like—after the diaphragm has been assembled—for the purpose of sealing of the diaphragm to adjacent turbomachinery, the need for welding or other metal joining techniques in the construction of the diaphragm is eliminated, with consequent saving of costs and reduced manufacturing time.
- Elimination of welding eliminates a possible source of defects in the structure of the diaphragm.
- The type of welding normally used in the construction of diaphragms normally comprises deep penetration welds requiring advanced and expensive laser or electron beam welding equipment. Elimination of welding therefore allows more choice in the selection of production facilities for construction of turbine diaphragms.

The above embodiments have been described above purely by way of example, and modifications can be made within the scope of the appended claims. Thus, the breadth and scope of the claims should not be limited to the above-described exemplary embodiments. Each feature disclosed in the specification, including the claims and drawings, may be replaced by alternative features serving the same, equivalent or similar purposes, unless expressly stated otherwise.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

The invention claimed is:

1. An axial flow turbine diaphragm including an annular array of blade units, each blade unit comprising:

an aerofoil;

radially inner and outer platforms integral with the aerofoil, the radially inner platform having a segment of the inner diaphragm ring and the radially outer platform having a segment of the outer diaphragm ring, at least the outer ring segment including engagement features that mechanically engage with complementary engagement features on neighbouring outer ring segments in the annular array of blade units, the engagement features acting to interlock neighbouring outer ring segments and produce a self-supporting turbine diaphragm, wherein the engagement features on the outer ring segment of each blade unit include hook features on both circumferentially facing sides of the outer ring segment that engage with complementary features on neighbouring outer ring segments of adjacent blade units, the hook features including radially extending grooves and being oriented to maintain axial location of each blade unit relative to its neighbours;

wherein the engagement features on the outer ring segment of each blade unit include tongue and groove features that engage with complementary features on the outer ring segments of adjacent blade units, the tongue and groove features being oriented to maintain a radial location of each blade unit relative to its neighbours, and the tongue and groove features comprise:

a groove on a circumferentially facing first side of the outer ring segment, the groove being formed as a gap between a radially outer part of a corresponding hook feature and a radially outer circumferentially projecting lip portion of the outer ring segment; and a circumferentially projecting tongue projecting from a circumferentially facing second side of the outer ring segment in exact opposition to the groove on the first circumferentially facing side.

2. An axial flow turbine diaphragm according to claim 1, in which the inner ring segment of each blade unit also comprises engagement features that mechanically engage with complementary features on neighbouring inner ring segments in the annular array of blade units and that are operative to produce a self-supporting turbine diaphragm in cooperation with the engagement features on the outer ring segments.

3. An axial flow turbine diaphragm according to claim 2, in which the engagement features on the inner ring segment of each blade unit comprise hook features having a radially extending groove that engage with complementary hook features on neighbouring inner ring segments of adjacent blade units, the hook features being oriented to maintain axial location of each blade unit relative to its neighbours.

4. An axial flow turbine diaphragm according to claim 3, in which the hook features are a first hook, formed by the radially extending groove proximate the pressure side of the aerofoil, and a second hook, formed by the radially extending groove proximate the suction side of the aerofoil.

5. An axial flow turbine diaphragm according to claim 4, in which the radially inner sides of the radially inner ring segments are configured as a seal, or are configured to retain a seal, such seal being operative to restrict leakage between relatively high and low pressure sides of the diaphragm.

6. An axial flow turbine diaphragm according to claim 3, in which the radially inner sides of the radially inner ring segments are configured as a seal, or are configured to retain a seal, such seal being operative to restrict leakage between relatively high and low pressure sides of the diaphragm.

7. A blade unit for an axial flow turbine diaphragm according to claim 3.

8. An axial flow turbine diaphragm according to claim 2, in which the radially inner sides of the radially inner ring segments are configured as a seal, or are configured to retain a seal, such seal being operative to restrict leakage between relatively high and low pressure sides of the diaphragm.

9. A blade unit for an axial flow turbine diaphragm according to claim 2.

10. An axial flow turbine diaphragm according to claim 1, in which the radially inner sides of the radially inner ring segments are configured as a seal, or are configured to retain a seal, such seal being operative to restrict leakage between relatively high and low pressure sides of the diaphragm.

11. A blade unit for an axial flow turbine diaphragm according to claim 1.

12. A method of assembling the turbine diaphragm of claim 1, comprising:

(a) producing the individual blade units to their final shape;

(b) placing a first blade unit on a flat surface ready for coupling with further blade units;

(c) sliding a second blade unit axially into engagement with the first blade unit and the flat surface so that engagement features on the outer ring segment of the second blade unit mate with the complementary engagement features on the outer ring segment of the first blade unit; and (d) successively sliding further blade units axially into engagement with blade units that are already engaged with each other and the flat surface until the annulus of the diaphragm is complete.

13. An axial flow turbine diaphragm according to claim 1, in which the radially inner sides of the radially inner ring segments are configured as a seal, or are configured to retain a seal, such seal being operative to restrict leakage between relatively high and low pressure sides of the diaphragm.

14. A blade unit for an axial flow turbine diaphragm according to claim 1.

* * * * *